US006578759B1

(12) United States Patent
Ortiz

(10) Patent No.: US 6,578,759 B1
(45) Date of Patent: Jun. 17, 2003

(54) CLIP FOR HOLDING CARTON FLAPS OPEN AND METHOD OF USE

(76) Inventor: Raul E. Ortiz, 822 via Bella Monica, San Marcos, CA (US) 92069-3627

( * ) Notice: Subject to any disclaimer, the term of this patent is extended or adjusted under 35 U.S.C. 154(b) by 0 days.

(21) Appl. No.: 10/134,247

(22) Filed: Apr. 26, 2002

(51) Int. Cl.[7] ..... B65D 43/24; B65B 43/26; A44B 21/00

(52) U.S. Cl. ..... 229/125; 24/563; 24/570; 53/410; 53/492

(58) Field of Search ..... 229/125; 24/455, 24/563, 570, 572.1; 53/133.1, 410, 492

(56) References Cited

U.S. PATENT DOCUMENTS 1,241,633 A * 10/1917 Johnson ..... 24/570
2,582,502 A * 1/1952 Nagler ..... 229/125
2,801,453 A 8/1957 Melvin
2,867,019 A * 1/1959 Streeter et al. ..... 229/125
2,894,308 A * 7/1959 Eckstein ..... 229/125
2,950,514 A 8/1960 Small
3,189,250 A * 6/1965 Haygeman ..... 229/125
3,349,446 A * 10/1967 Haygeman ..... 229/125
4,068,353 A 1/1978 Speers et al.
4,408,689 A * 10/1983 Daniels ..... 229/125
4,449,662 A 5/1984 Okamura et al.
4,528,800 A 7/1985 Burns
4,641,402 A * 2/1987 Vansant et al. ..... 24/570
4,761,935 A 8/1988 King et al.
5,699,958 A 12/1997 Kohler
6,290,126 B1 9/2001 Zudal

* cited by examiner

*Primary Examiner*—Gary E. Elkins
(74) *Attorney, Agent, or Firm*—MaryJo Redman; Calif Tervo

(57) ABSTRACT

Clip (10) for holding lid flaps (110) of a carton (100) in an open position against carton walls (101) to facilitate packing of carton (100). Clip (10) includes a horizontal spine (20) to which are attached a center post (30), a long prong (40) a short prong (50), and a handle tab (25). To use clip (10), clip (10) is positioned with center post (30) above a corner (107) of carton (100) and lowered to insert center post (30) in interior dihedral angle (108) of corner (107). Long prong (40) contacts a first lid flap (110) and rotates flap (110) into the open position. Short prong (50) contacts a second flap (110) shortly afterward and rotates second flap (110) into an open position.

16 Claims, 2 Drawing Sheets

CLIP FOR HOLDING CARTON FLAPS OPEN AND METHOD OF USE

FIELD OF THE INVENTION

This invention relates to a clip for carton lid flaps, and more specifically relates to a reuseable clip without moving parts for holding the lid flaps of packing cartons in an open position and to a method of using the clip.

BACKGROUND OF THE INVENTION

Cardboard boxes or cartons are ubiquitous in manufacturing companies, retailers who deliver customers' orders, and print shops. The most familiar cardboard carton is a square or rectangular box stamped from a single piece of corrugated cardboard. The cardboard sheet is slit and scored into a shape that can be folded and glued into a cube or rectangular prism with four walls attached to each other and attached flaps to form the bottom and lid. This type of carton is sometimes called a self-closing carton because there is no separate lid.

The cartons are usually stored flat and assembled only when needed for filling. The packing operation in a business often assembles as many cartons as will fit on the floor of the packing area and fills the cartons with goods in assembly-line fashion. Often, styrofoam packing material, such as the nuggets called "popcorn," is dispensed from a hopper via a movable chute into the cartons to protect the goods.

To assemble a new carton, the packer pops the flat walls into a cube or rectangle prism. The lid and bottom flaps are scored for folding, but generally each is initially extended coplanar with the wall to which the flap is attached. The packer folds the bottom flaps inward to cover the bottom of the carton and tapes them in place, or secures any other fastening arrangement, such as tabs and slots.

The fresh carton is set on the floor on its bottom and made ready for packing. Leaving the lid flaps in the extended position makes loading the carton inconvenient. "Popcorn" must be dispensed from farther away and more is spilled than when it is dispensed directly into the interior of the carton. The extended flaps are rigid and abrasive. People packing cartons frequently cut or scrape their hands, arms, and even faces when bending over the carton.

The lid flaps may be folded down from the extended position, but the springiness of the cardboard of a fresh carton prevents the flaps from staying in the fully open position adjacent the outside face of the carton wall. Folded-down flaps usually end up spread outward from the carton walls. The outspread flaps allow fewer cartons to fit on the floor of the packing area and cause the cartons to be arranged less neatly than desired for efficient, fast packing. Flaps of adjacent boxes interfere; picking up or bumping a carton may overturn nearby cartons.

Some packers fasten the lid flaps in the open position in some manner. Clips for holding the flaps open are known, but are not in commercial use. Of clips that have been patented, some are awkward to use; some are too bulky to store; and some pose danger to the user. Others are for specialized use or would disfigure the carton, which is unacceptable to most shippers.

Some packers put a piece of adhesive tape on each flap to hold it in the open position. This also tends to disfigure the carton and wastes the packer's time trying to remove the tape carefully. Other packers create chain loops of intertwined rubber bands that can be slipped around the entire perimeter of the carton to hold the flaps. This is a popular and traditional craft on shipping docks, but not really a means for making packing efficient or speedy. The chains fit only a limited range of size of carton and do not last long.

Therefore, there has been a need for an easy to use device for helping a person pack or unpack a cardboard carton more efficiently, safely, and quickly. Such a device must be simple to use, convenient to store, and durable. The device must not cause damage to the carton or goods being packed or unpacked.

SUMMARY OF THE INVENTION

The invention is a clip for holding the lid flaps of a cardboard carton in an open position for convenient and safe packing of the carton.

The clip is generally a linear spine with three tines: a center post, a long prong, and a short prong. In use, the center post is inserted into an interior corner of a carton. The prongs are spaced apart from the center post sufficiently that the prongs fall on the exterior of the carton walls when the center post is within the corner. As the clip is lowered onto the corner of the carton, the prongs each engage a lid flap and lever the flap downward.

The long prong is about the same length as the center post, but the short prong is shorter than either. The unequal length of the prongs allows the packer to insert the clip over one flap at a time while holding down the flap with one hand.

The preferred embodiment described below is of a universal design that can be used in an approximately right-angled corner of a carton of any size. Generally, two clips per carton would be used; one clip in each diagonally opposite corner. Each clip holds the two flaps adjacent the corner.

The present invention is a means of holding the lid flaps of cartons in the open position so that the greatest number of cartons will fit on the floor of the packing area in a neat matrix for high speed packing. The clip is reuseable and durable, and can be stored in minimal space on a shelf. The clip is safe and easily used by a single packer. The clip does not impair access to the interior space of the carton, does not disarrange the packed goods when it is removed, and does not damage or disfigure the carton.

The invention will now be described in more particular detail with respect to the accompanying drawings in which like reference numerals refer to like parts throughout.

DETAILED DESCRIPTION OF THE INVENTION

Figure 1:
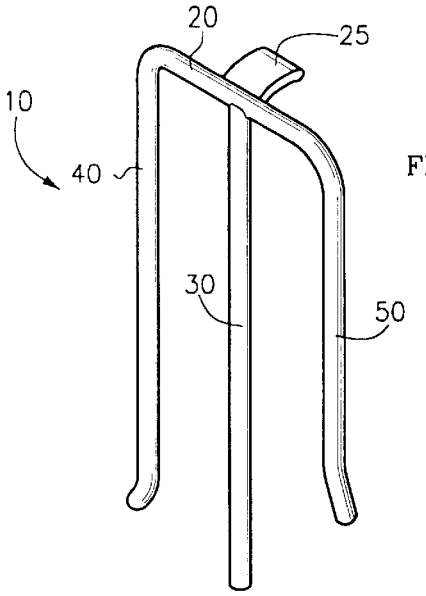
FIG. 1 is a rear perspective view of the clip of the present invention.
Figure 2:
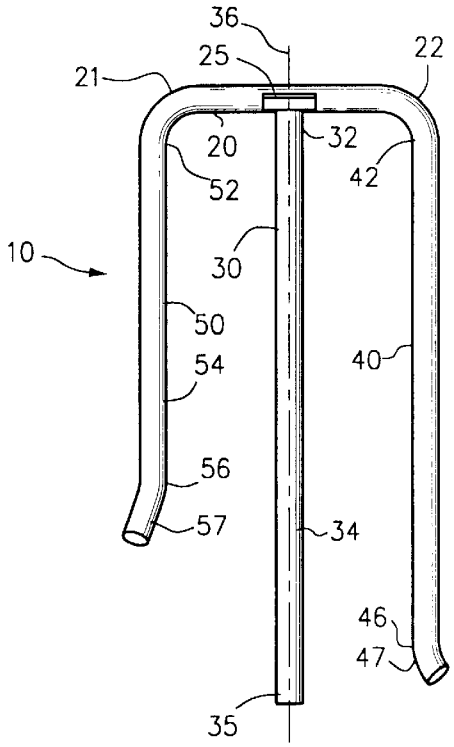
FIG. 2 is a front elevation view of the clip of FIG. 1.
Figure 3:
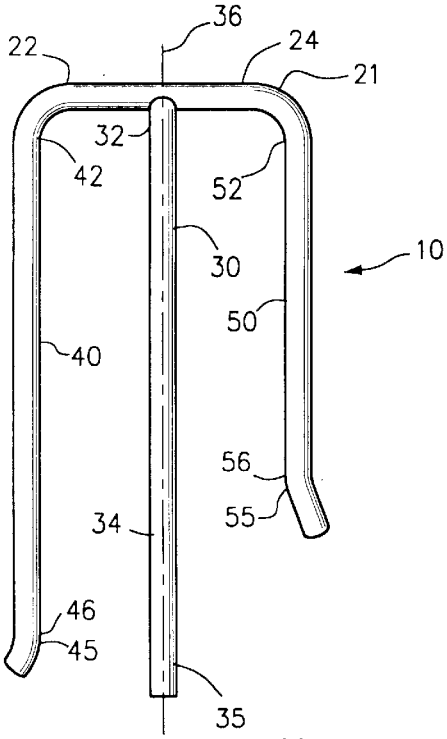
FIG. 3 is a rear elevation view of the clip of FIG. 1.
Figure 4:
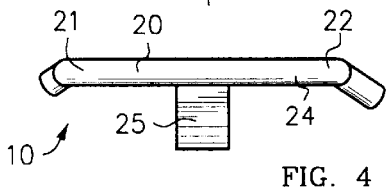
FIG. 4 is a top plan view of the clip of FIG. 1.
Figure 6:
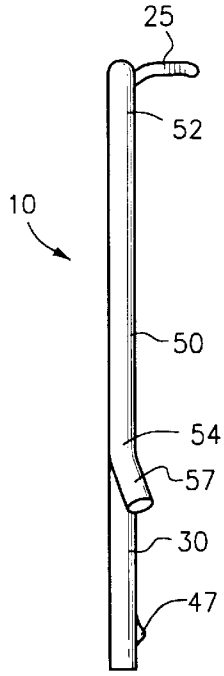
FIG. 6 is a left side view of the clip of FIG. 1.
Figure 7:
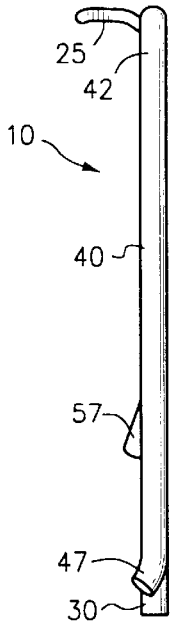
FIG. 7 is a right side view of the clip of FIG. 1.
Figure 5:
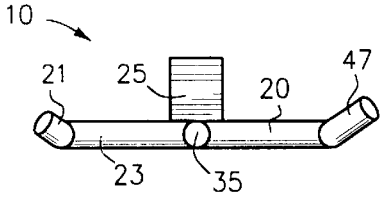
FIG. 5 is a bottom view of the clip of FIG. 1.

FIG. 1 is a rear perspective view of the clip 10 of the present invention. FIG. 2 is a front elevation view of clip 10 of FIG. 1. FIG. 3 is a rear elevation view of clip 10 of FIG. 1. FIG. 4 is a top plan view of clip 10 of FIG. 1. FIG. 5 is a bottom view of clip 10 of FIG. 1. FIG. 6 is a left side view of clip 10 of FIG. 1. FIG. 7 is a right side view of clip 10 of FIG. 1.

Clip 10 generally includes a spine 20, a center post 30, a long prong 40, and a short prong 50. Spine 20, center post 30, and prongs 40,50 are generally co-planar so that a pile of clips 10 can rest on a shelf without tangling together or sliding around.

Spine 20 includes a first end 21, a second end 22, and a middle portion 23 between ends 21,22. Proximal end 42 of long prong 40 is attached to first end 21 of spine 20 and extends downward from spine 20. Proximal end 52 of short prong 50 is attached to second end 22 of spine 20 and extends downward. Center post 30 is attached to middle portion 23 and extends downward. Proximal end 32 of center post 30 is attached to middle portion 23 of spine 20 and extends downward. Center post 30 has a longitudinal axis 36 . Long prong 40 and short prong 50 are spaced apart from center post 30 and are generally parallel to longitudinal axis 36.

Spine 20 also preferably includes a handle, such as tab 25 attached to middle portion 23.

Figure 8:
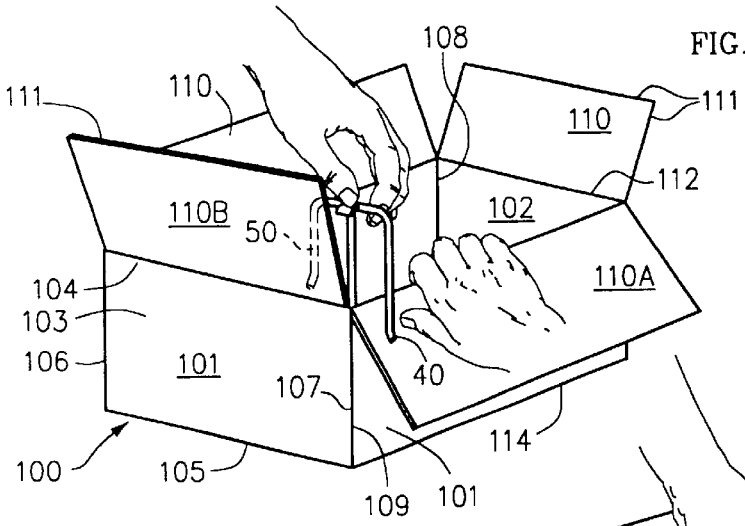
FIGS. 8 and 9 show the method of use of the clip of FIG. 1, depicting a user applying the clip to a corner of a carton.
Figure 9:
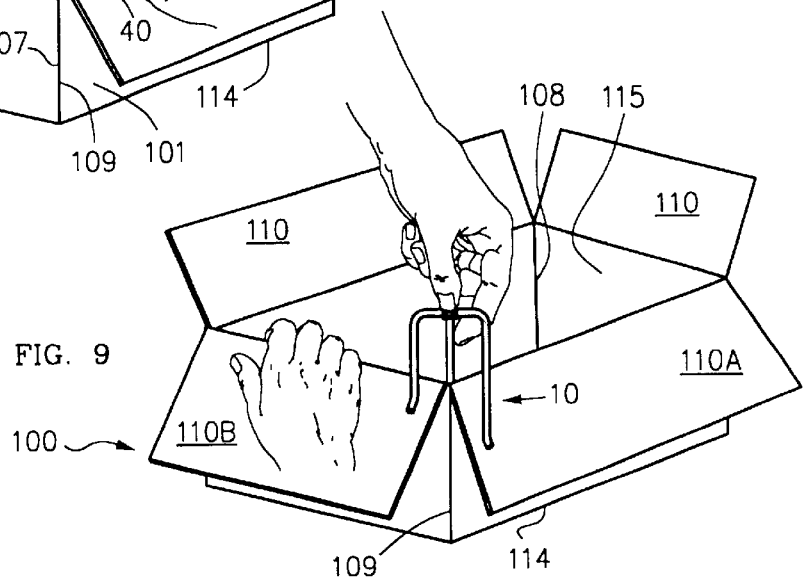
Figure 10:
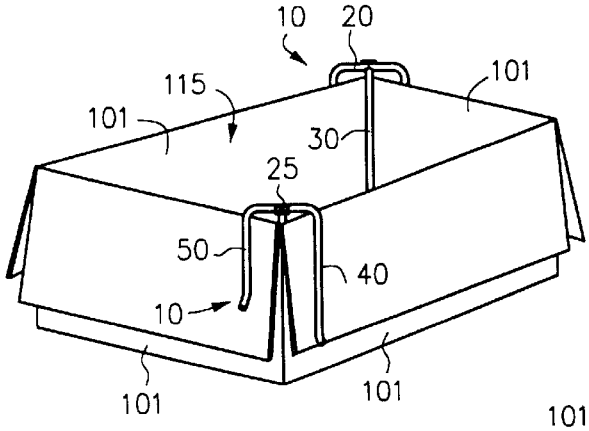
FIG. 10 is a perspective view of the carton of FIG. 9 with two clips of the present invention holding four flaps of the carton.
Figure 11:
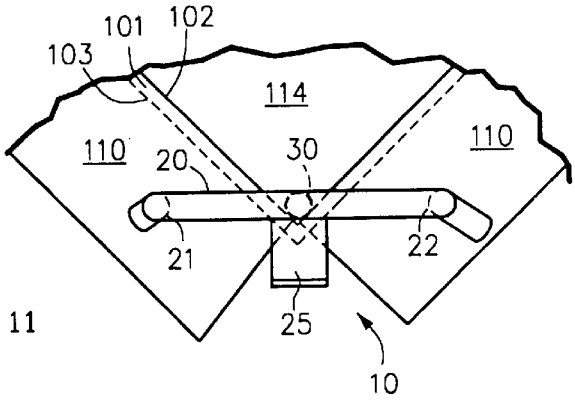
FIG. 11 is a top view, partly cut away, of a corner of the carton of FIG. 10 with a clip inserted in the corner.

FIGS. 8 and 9 show the method of use of clip 10 of FIG. 1, depicting a user applying clip 10 to a corner 107 of a carton 100. FIG. 10 is a perspective view of carton 100 of FIG. 9 with two clips 10 on carton 100. FIG. 11 is a top view, partly cut away, of corner 107 of carton 100 of FIG. 10 with clip 10 inserted in corner 107.

Carton 100 generally includes four walls 101 attached to each other so as to enclose an inside volume 115. Each wall 101 includes a top edge 104, a bottom edge 105, two side edges 106, an inner face 102, and an outer face 103. Each wall 101 is attached to two other walls 101 along their respective adjoining side edges 106. Two attached walls 101 form a corner 107. Corner 107 includes an interior dihedral angle 108 formed by the two inner faces 102 of attached walls 101 and an exterior dihedral angle 109 formed by the outer faces 103 of attached walls 101.

Each wall 101 is attached along its top edge 104 to a lid flap 110. Top edge 104 serves as a hinge for flap 110, allowing each flap 110 to rotate from a tucked-in position against inner face 102 of its attached wall 101 nearly 360° to the open position against outer face 103 of wall 101. Flap 110 includes attached edge 112 attached to top edge 104 of wall 101, and three free edges 111.

In FIG. 8, three of flaps 110 are shown in an intermediate upwardly-extended position. A hand is shown pushing the right front flap 110 toward the open position against its attached wall 101 as clip 10 is lowered into place in corner 107.

To close carton 100, flaps 110 are rotated inward such that each flap 110 is at 90° to its attached wall 101 and covering inside volume 115. The floor or bottom 114 of carton 100, not fully shown, comprises floor flaps in a similar arrangement.

The method of using clip 10 begins with using a first hand to push a first lid flap 110A of carton 100 toward the open position, while gripping clip 10 with a second hand and positioning clip 10 with center post 30 above a corner 107 adjacent first flap 110A. Clip 10 is lowered toward corner 107. Center post 30 slides along interior dihedral angle 108 of corner 107 and long prong 40 comes into contact with and pushes against first flap 110A.

After long prong 40 has engaged first flap 110A, the first hand is free to move over and push the second flap 110B toward the open position. Clip 10 is lowered further until short prong. 50 contacts the second flap 110B and begins pushing the second flap 110B to the open position. Clip 10 may then be lowered until spine 20 is conveniently close to top edges 104 of walls 101 adjacent corner 107.

FIG. 10 shows a carton 100 with a clip 10 in each of two diagonally-opposite corners 107. Because each clip 10 holds two adjacent flaps 110, two clips 10 retain all four lid flaps 110 of carton 100 in the open position. Clip 10 is preferably fabricated from metal rods, thus the weight of two clips 10 aids in preventing carton 100 from being accidentally tipped over during the packing operation.

Clip 10 could alternatively be fabricated of plastic, such as a tough injection moldable plastic. The material used must be durable and able to be flexed slightly without fatigue embrittlement, and should be non-marking and with low coefficient of friction. Anodized aluminum or painted or powder-coated steel are suitable metals; ABS or nylon are suitable plastics.

If carton 100 is new, with stiff, springy attachments between top edges 104 and flaps 110, pushing clip 10 downward against flaps 110 is not an efficient way to rotate flaps 110 to the open position and it is preferable to use a hand to start the rotation. The action of the hand pushing a first flap 110 and then a second flap 110 toward the open position is efficient and natural.

If carton 100 has been previously used and the attachments of top edges 103 to flaps 110 have become non-springy, clip 10 can be pushed against first and second flaps 110 to rotate flaps 110 from the extended to the open position without aid from a hand pushing on flap 110.

The difference in lengths of long prong 40 and short prong 50 causes only one flap 110 at a time to be engaged by clip 10. This feature of clip 10 allows the first hand to fold flaps 110 in sequence.

If prongs 40,50 were of equal length, both the first and the second flaps 110 would need to be pushed downward simultaneously, requiring the use of the packer's legs to hold flaps 110 in the open position while pushing clip 10 downward with a hand, or use of both hands to hold flaps 110 in the open position while nudging clip 10 downward with the chin, or other awkward postures.

Because prongs 40,50 must push straight downward against flaps 110 that may be angled outward from the vertical, each of prongs 40,50 include slide means 45,55 for sliding along a flap 110 without digging into or scratching the cardboard of flap 110. Slide means 45,55 may comprise any of several different means for accomplishing this, such as including a beveled tip (not shown) on prongs 40,50; including an enlarged rounded knob (not shown) on prongs 40,50; or the slide means 45 illustrated in the drawings, which is a bent portion 46 of long prong 40 and a bent portion 56 of short prong 50.

Bent portions 46,56 accommodate for the angle of flaps 110 away from walls 101 and use a downward force on clip 10 to rotate flaps 110 to the open position. Tip end 47 is the part below bent portion 46 of long prong 40. Tip end 57 is the part below bent portion 56 of short prong 50. Tip ends 47,57 do not touch flaps 110 during use of clip 10. Center post 30 does not include slide means because center post 30 slides vertically down vertical interior dihedral angle 108 when clip 10 is inserted into corner 107.

Bent portions 46,56 preferably cause tip ends 47,57 to point generally normal to the plane of the flap 110 on which prongs 40,50, respectively, push. Tip ends 47,57 also point substantially at right angles to each other.

Handle tab 25 is generally perpendicular to spine 20. When clip 10 is inserted into corner 107 in the orientation shown in FIGS. 8 through 10, handle tab 25 projects radially from corner 107, as seen in FIG. 11. Bottom 114 of carton 100 may be seen in FIG. 11. Clip 10 can be inserted into corner 107 easily by gripping spine 20, center post 30 and prongs 40,50 in any means comfortable. To remove clip 10 from corner 107, it is easier to pull upward on handle tab 25 because most of clip 10 is lying against parts of carton 100.

Clip 10 could be inserted into corner 107 in the mirror image of that depicted in FIGS. 8 through 11. Clip 10 would hold flaps 110 in the open position equally well, but tab handle 25 would be projecting into inside volume 115 of carton 100 and would be slightly less accessible for retrieval.

A four-sided carton 100 has been described and illustrated herein, but other types of cartons can be packed using clip 10. All that is required is that the spacing between center post 30 and prongs 40,50 be such that prongs 40,50 fall on the outside of carton 100 when center post 30 is inserted into interior dihedral angle 108 and that prongs 40,50 push down flaps 110 and hold flaps 110 in an open position.

Flaps 110 have been described and illustrated herein as extending along the length of top edge 104 of carton wall 101. Clip 10 can be used for packing cartons 100 that do not have flaps 110 the entire length of top edge 104. The distance between center post 30 and a prong 40,50 must be at least equal to the sum of the thickness of flap 110, the thickness of wall 101, plus the length of top edge 104 adjacent to corner 107 that is not attached to flap 110.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A clip for holding lid flaps of a carton in an open position; the carton including: at least two walls attached to each other; each wall including a top edge, two side edges, an inner face, and an outer face; the walls being attached to each other along their adjoining side edges to form a corner; the corner including an interior dihedral angle formed by the inner faces of the attached walls and an exterior dihedral angle formed by the outer faces of the attached walls; the carton further including a lid comprising at least a first flap and a second flap; each flap including an attached edge attached to the top edge of a wall of the carton and hingedly moveable between a closed position and an open position wherein the flap is alongside the outer face of its attached wall; said clip including:

a spine; including:
a first end;
a second end; and
a middle portion between said first and second ends;

a long prong attached to said first end of said spine and extending downward, for holding the first lid flap in an open position;

a short prong attached to said second end of said spine and extending downward, for holding the second lid flap in an open position; said short prong being shorter than said long prong; and a center post for insertion into an interior dihedral corner of the carton, attached to said middle portion of said spine and extending downward; said long prong and said short prong spaced apart from said center post by a distance sufficient to allow each said prong to hold a flap in an open position.

2. The clip of claim 1, said long prong and said short prong both being substantially parallel to said center post.

3. The clip of claim 1, said long prong and said short prong each including:

slide means for sliding along and pushing against a carton flap.

4. The clip of claim 3, said long prong and said short prong each including:

a proximal end attached to said spine; and a tip end opposite said proximal end; and wherein said slide means includes:

a bent portion between said proximal end and said tip end.

5. The clip of claim 4, wherein said long prong tip end and said short prong tip end point at a right angle to each other and each points generally normal to the plane of the flap on which said tip end pushes.

6. A method for holding lid flaps of a carton in an open position; the carton including: at least two walls attached to each other; each wall including a top edge, a side edge, an inner face, and an outer face; the walls being attached to each other along their adjoining side edges to form a corner; the corner including an interior dihedral angle formed by the inner faces of the attached walls and an exterior dihedral angle formed by the outer faces of the attached walls; the carton further including a lid comprising at least a first flap and a second flap; each flap including an attached edge attached to the top edge of a wall of the carton and hingedly moveable between a closed position and an open position wherein the flap is alongside the outer face of its attached wall;

providing a clip including a spine; the spine including: a first end; a second end; and a middle portion between the first and second ends; a long prong attached to the first end of the spine and extending downward, for holding the first lid flap in an open position; a short prong that is shorter than the long prong, attached to the second end of the spine and extending downward, for holding the second lid flap in an open position; and a center post for insertion into an interior dihedral corner of the carton, attached to the middle portion of the spine and extending downward; the long prong and the short prong spaced apart from the center post by a distance sufficient to allow each prong to hold a flap in an open position;

holding the clip above a corner of the carton;

lowering the clip until the slide means of the long prong contacts and pushes against the first lid flap and such that the center post is disposed in the interior dihedral angle of the corner;

lowering the clip until the slide means of the short prong contacts and pushes against the second lid flap; and lowering the clip until the first and second lid flaps are in the open position.

7. The method of claim 6, wherein the step of:

holding the clip above a corner of the carton includes the substep of:

gripping the clip with a first hand and pushing the first flap toward an open position with the second hand; and the step of:

lowering the clip until the slide means of the short prong contacts and pushes against the second flap includes the substep of:

using the second hand to push the second flap toward an open position against the outer face of the wall.

8. The method of claim 7; wherein the carton includes at least four walls joined at four corners; a clip is inserted into a first corner and a second clip is inserted into a second corner diagonally opposite the first corner.

9. In combination:

a carton including:

four walls attached to each other to define an inside volume that is a rectangular prism; each said wall including:

a top edge;

two side edges;

an inner face facing said inside volume; and an outer face facing outward; each said wall being attached to another said wall along their adjoining said side edges to form a corner; said corner including:

an interior dihedral angle formed by said inner faces of said two attached walls; and an exterior dihedral angle formed by said outer faces of said two attached walls;

a lid comprising:

a plurality of flaps; each said flap including:

an attached edge attached to said top edge of a said wall of said carton and hingedly moveable between a closed position and an open position wherein the flap is alongside the outer face of its attached said wall; and a clip for holding two flaps adjacent a corner in an open position; said clip including:

a spine; including:

a first end;

a second end; and a middle portion between said first and second ends;

a long prong attached to said first end of said spine and extending downward, for holding the first lid flap in an open position;

a short prong attached to said second end of said spine and extending downward, for holding the second lid flap in an open position; said short prong being shorter than said long prong; and a center post for insertion into an interior dihedral corner of the carton, attached to said middle portion of said spine and extending downward; said center post being substantially equal in length to said long prong; and said long as prong and said short prong spaced apart from said center post by a distance sufficient to allow each said prong to hold a flap in an open position.

10. The combination of claim 9; said spine including:

a handle for manipulating said clip.

11. The combination of claim 9, said long prong and said short prong both being substantially parallel to said center post.

12. The combination of claim 11, said long prong and said short prong each including:

slide means for sliding along and pushing against a carton flap.

13. The combination of claim 12, said long prong and said short prong each including:

a proximal end attached to said spine;

a tip end opposite said proximal end; and wherein said slide means includes:

a bent portion between said proximal end and said tip end; such that said tip end does not contact said wall of said carton during use of said clip.

14. The combination of claim 13, wherein said long prong tip end and said short prong tip end point at a right angle to each other and each points generally normal to the plane of said flap on which said prong pushes.

15. The combination of claim 10, said handle comprising a tab adapted for grasping between a thumb and finger and with a longitudinal axis perpendicular to said spine, such that said tab protrudes radially outward from said exterior dihedral angle of said corner when said center post is disposed in said interior dihedral angle.

16. The combination of claim 13, said spine being generally linear and horizontal.

* * * * *